US005339475A

United States Patent [19]

Jaeger et al.

[11] Patent Number: 5,339,475

[45] Date of Patent: Aug. 23, 1994

[54] LOAD SUPPORTING STRUCTURE

[75] Inventors: Leslie G. Jaeger, Herring Cove; Aftab A. Mufti, Halifax; Baidar Bakht, Scarborough, all of Canada

[73] Assignee: The Queen in Right of Ontario as represented by the Ministry of Transportation, Canada

[21] Appl. No.: 889,497

[22] Filed: May 27, 1992

[30] Foreign Application Priority Data

May 30, 1991 [GB] United Kingdom ..... 9111649
May 22, 1992 [GB] United Kingdom ..... 9211017

[51] Int. Cl.[5] ..... E01D 19/12; E01D 7/00; E04B 5/14

[52] U.S. Cl. ..... 14/73; 404/70

[58] Field of Search ..... 14/73, 74.5; 404/43, 404/45, 70; 52/177, 338

[56] References Cited

U.S. PATENT DOCUMENTS 3,320,704 5/1967 Forsythe et al. ..... 52/338
3,630,237 12/1971 Varnell et al. ..... 138/176
3,842,552 10/1974 Hudson ..... 14/73 X
3,980,484 9/1976 Shaw ..... 106/711 X
4,047,962 9/1977 Copeland ..... 106/674
4,151,694 5/1979 Sriberg et al. ..... 52/338 X
4,810,552 3/1989 Meyer ..... 106/711 X
4,952,631 8/1990 McAlpin et al. ..... 525/106 X
4,991,248 2/1991 Allen ..... 14/73

FOREIGN PATENT DOCUMENTS 0239208 9/1989 Japan ..... 14/73

*Primary Examiner*—Ramon S. Britts
*Assistant Examiner*—James A. Lisehora
*Attorney, Agent, or Firm*—Ladas & Parry

[57] ABSTRACT

A load supporting structure includes a pair of beams with tension members extending between them. A deck formed from fiber reinforced concrete is supported on the beams with fasteners extending between the beams and deck. The tension members provide sufficient rigidity to allow an arching action to develop within the deck and thereby avoid the need for steel reinforcements within the deck.

19 Claims, 3 Drawing Sheets

LOAD SUPPORTING STRUCTURE

FIELD OF THE INVENTION

The present invention relates to load supporting structures.

Load supporting structures are used to span between spaced vertical supports and can typically be used in highway bridges and parking garages. A common construction utilizes beams or girders to support a concrete slab known as a deck. The beams can be made of either steel or concrete and are dimensioned such as to be able to transfer the loads from the deck into the vertical supports.

DESCRIPTION OF RELATED ART

It is well known that concrete is relatively strong in compression but relatively weak in tension. Because of this, the concrete slab is normally provided with steel reinforcements that usually take the form of steel bars. These bars are laid in a grid in both longitudinal and transverse directions and are located both at the bottom and at the top of the deck slab.

The placement of the reinforcing bars is done manually and is therefore relatively time consuming. Moreover, the bars have to be located within the formwork used to cast the slab in situ which further increases the expense and time taken to produce the slab.

In a "slab-on-girder" type highway bridge commonly used in Ontario, Canada, each of the top and bottom reinforcements typically comprises about 0.3% by volume of longitudinally running steel bars and 0.3% by volume of transversely running steel bars. To provide the requisite strength to the slab, the bars must be located adjacent to the top and bottom of the deck. However, a commonly occurring problem with such deck slabs is that of corrosion of the reinforcing steel bars. This corrosion may occur from reaction with the constituents of the concrete used to form the slab but also from reaction with the outside environment such as salt used to remove snow and ice from the support structure or moisture within the air. In order to slow down the onset of corrosion the steel bars are frequently given a suitable protective coating and a minimum protective cover of concrete is provided on the bars. While such action does retard the onset of corrosion, inevitably corrosion will occur resulting in a reduction in the life of the structure and expensive repair procedures requiring portions of the deck to be removed for inspection and repair.

Moreover, the need to cover the reinforcing steel with concrete leads to thickness of the deck that is greater than that needed to support the load. This not only increases the volume of and expense of the deck but leads to a corresponding increase in the strength and expense of the supporting structure.

It is therefore an object of the present invention to provide a load supporting structure in which the above disadvantages are obviated or mitigated.

SUMMARY OF THE INVENTION

According to the present invention there is provided a load supporting structure to span a pair of spaced vertical supports said structure comprising a pair of laterally spaced beams extending between the supports, tension members extending between said beams and being secured thereto to inhibit relative lateral movement between said beams, a deck supported by the beams, and fastening means extending between said deck and said beams to inhibit relative movement therebetween, said deck being formed from concrete impregnated with non-metallic fibres and dimensioned to transfer loads carried by the deck to the supports through the beam.

BRIEF DESCRIPTION OF THE DRAWINGS

An embodiment of the invention will now be described by way of example only with reference to the accompanying drawings, in which.

DESCRIPTION OF PREFERRED EMBODIMENTS

Figure 1:
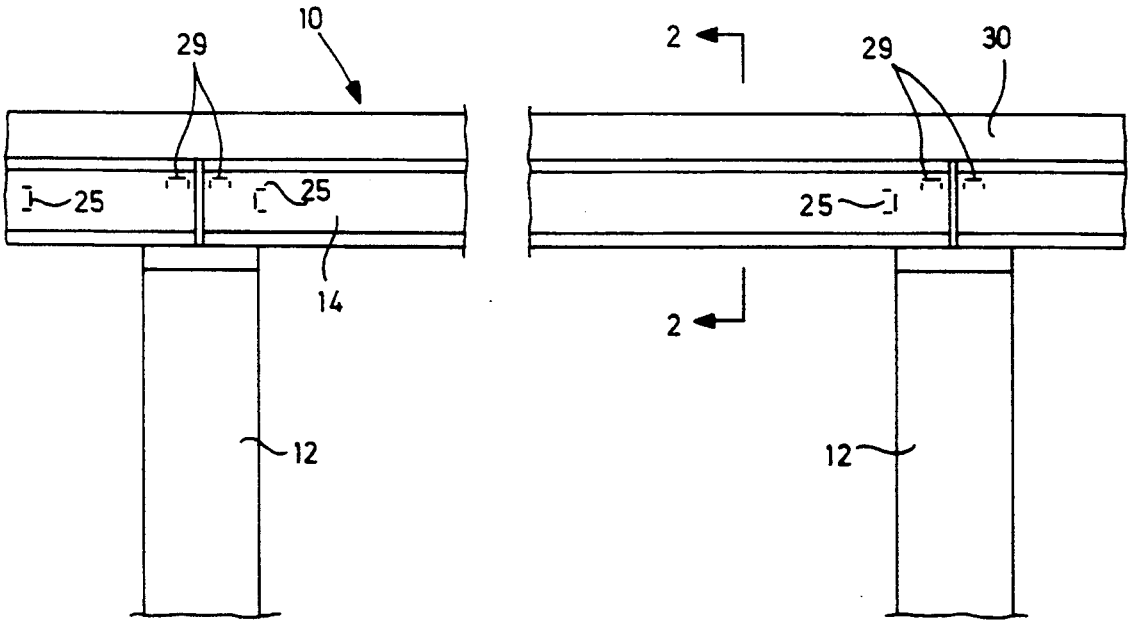
FIG.1 is a side view of a load supporting structure.

Referring therefore to FIG. 1, a load supporting structure indicated generally at 10 extends between a pair of vertical supports 12. The supports 12 are suitable columns or abutments capable of supporting the loads imposed on the load supporting structure.

A pair of laterally spaced beams 14,16 extend between the vertical supports 12 and, in the embodiment shown, I-section structural steel joists are used. Alternatively, concrete beams or other configurations of steel beams such as rectangular or box beams could be used. It will be appreciated that an appropriate number of lateral spaced beams may be used to provide a deck of the required width. The beams 14,16 are supported on the supports 12 by pads 18. Each of the beams 14,16 has a central web 20 and upper and lower flanges 22,24. The beams 14,16 are maintained in spaced parallel relationship by structural members 25 located on the webs of the beams 14,16 near the supports 12.

Extending between the upper webs 22 is a series of steel straps 26 that act as tension members between the beams 14,16. The steel straps 26 are secured to the flanges 22 either by welding or other suitable forms of fastening such as bolts or rivets.

The beams 14,16 are connected at opposite ends by channels 29 that are secured to the flanges 22 in a manner similar to the straps 26. The channels 29 are oriented with their webs in the horizontal plane to provide the maximum stiffness in that plane. A series of shear studs 32 are secured at spaced intervals along the upwardly directed surface of channels 29 and at regularly spaced intervals along the flanges of each beam 14,16. The studs 32 are conventional fasteners used to secure a concrete structure to a steel structure such as those commercially available and known as "Nelson studs".

A deck 30 is supported on the upper surface of the flange 22. The deck 30 is attached to each of the flanges 22 and the channels 29 by the studs 32 to provide the necessary lateral stiffness. The deck 30 is formed from concrete impregnated with randomly distributed fibres. The fibres may be of any suitable material, preferably non-metallic, such as one or more of the group of carbon fibres, aramid fibres, polypropylene or suitable equivalent fibres. The fibres are mixed within the concrete prior to forming the slab which is cast in situ by utilizing appropriate form work (not shown).

The deck 30 preferably uses a fibre content of at least 5 parts in 1000 by volume. The concrete mixture would use a super plasticizer to improve the flow characteristics of the wet concrete.

The fibres are preferably not more than 0.05 mm in diameter and not more than 40 mm in length when polypropylene is used. However, other lengths and diameters may be utilized depending on the particular circumstances in which the support structure is to be used.

In general terms, sufficient fibres should be included within the concrete to provide a tensile strength for the concrete slab that is at least 20% of the compressive strength of the slab.

Figure 2:
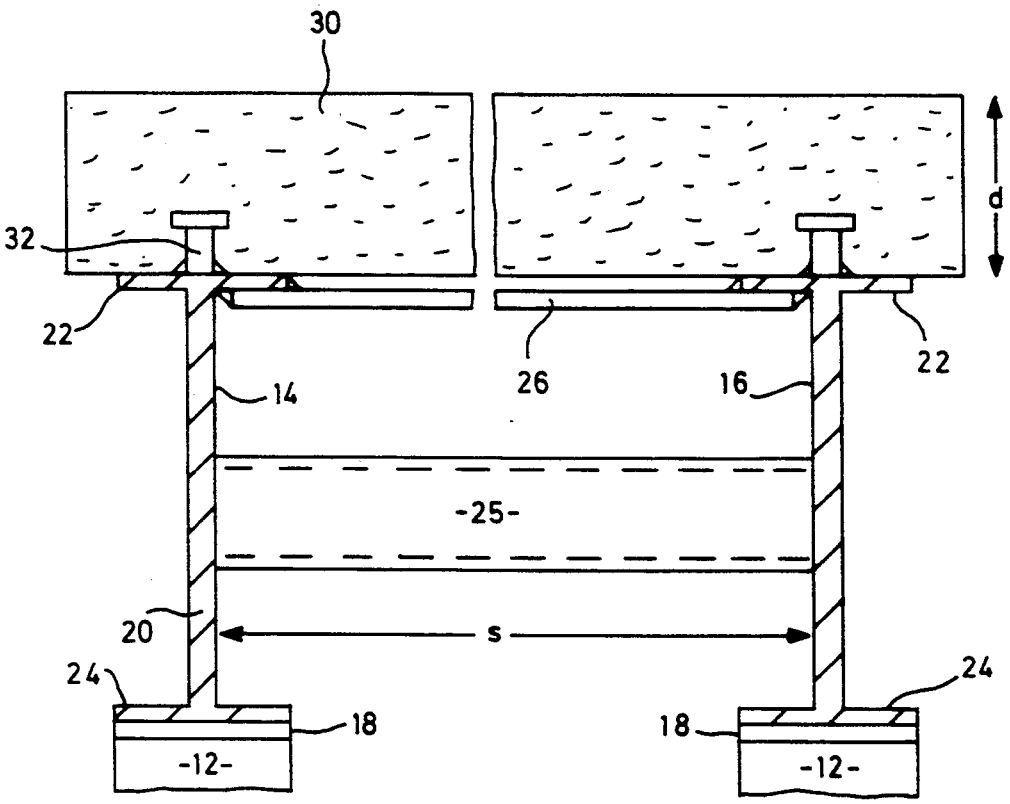
FIG. 2 is a view of the line 2—2 of FIG. 1.
Figure 3:
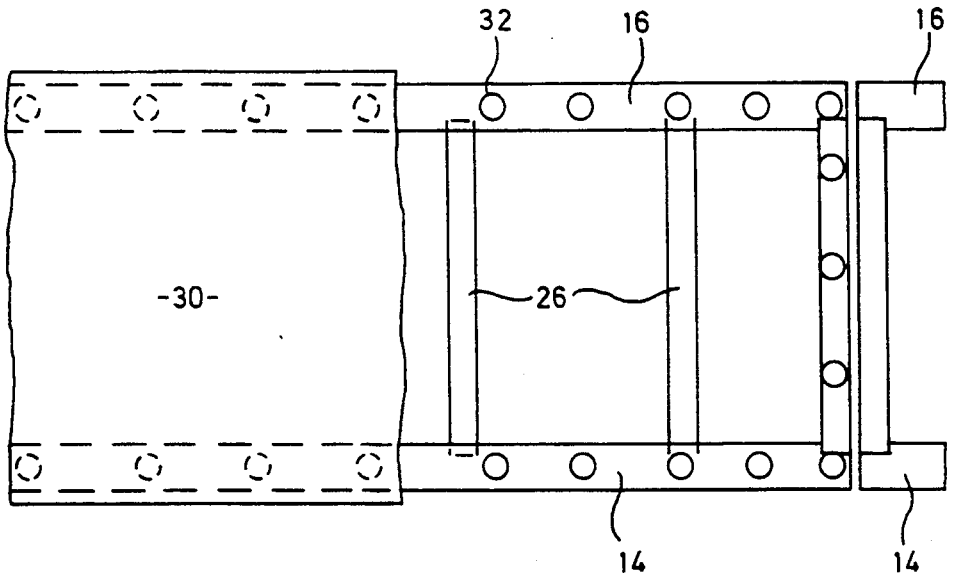
FIG. 3 is a plan view of FIG. 1 with portions of the structure removed for clarity.
Figure 4:
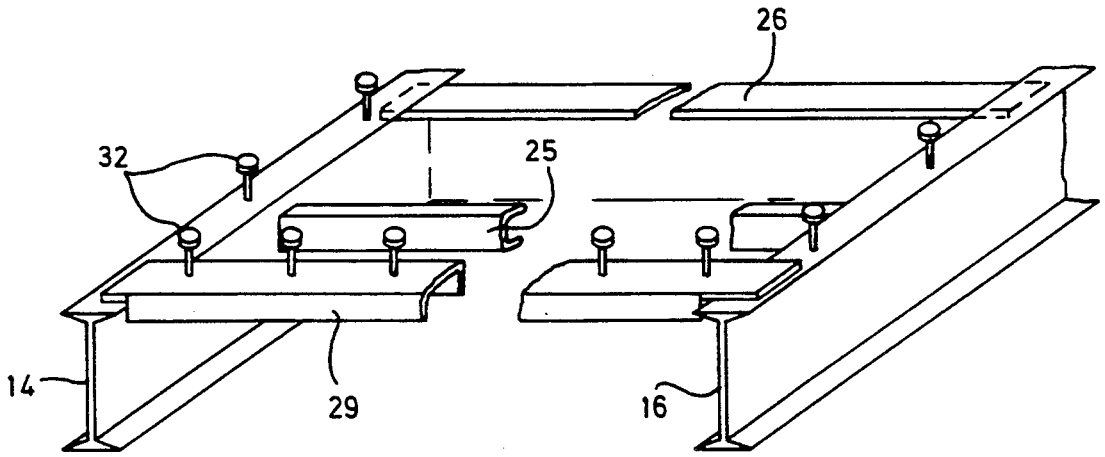
FIG. 4 is a perspective view of a portion of a supporting frame of the structure shown in FIG. 1.

The depth of the deck 30 indicated at (d) in FIG. 2 is such as to permits loads imposed on the upper surface of the deck 30 to be transferred to the beams 14,16 through an arching action. In general terms, a ratio of depth (d) to span (s) should be less than 1:14, that is the depth (d) should be at least 1/14 of the span (s).

With loads imposed on the deck being transferred to the beams 14, the straps 26 are utilized to inhibit any laterally outward movement of the flanges 22 of the beams 14. The spacing and cross-section of the straps 26 will again depend upon the nature of the loads imposed but typically the longitudinally spacing between the straps should be not more than ½ of the span (s). The cross-sectional area of the strapping should be not less than 0.4% of the cross-sectional area of the deck 30 supported by the strap. Thus if the deck is 225 mm thick with the straps 26 spaced 1 meter apart, the cross-sectional area of each strap should be in the order of 900 $mm^2$. Suitable sections of structural steel can be utilized for the straps 26.

It will be noted that in the embodiment shown, the deck 30 is formed without steel reinforcing structure embedded within the deck and therefore the inherent corrosive action between the concrete and the steel reinforcing rods is avoided. The straps 26 are spaced from the underside of the deck to avoid any contact between the concrete and the straps and in the event that corrosion is induced by the environment, the straps 26 are readily available for inspection and/or replacement as necessary. This can be done without disturbing the deck 30.

Straps 26 should be located so as to ensure that the loads transferred from the deck to the flanges 22 through studs 32 do not induce laterally outward motion of the flanges. Where I-section beams 14 are utilized, then the strap 26 should be placed adjacent to the upper flange 22 as the web 14 is relatively flexible and would allow outward movement of the flanges 22. This would prevent the slab 30 taking the imposed loads through the arching action mentioned above.

However, if different section of beams 14 are used that exhibit increased lateral stiffness then alternative forms and locations of tension members 26 could be utilized. For example, where box beams are utilized instead of the I-beams 14, the tension members 26 could be in the form of steel tubing extending across the neutral axis or slightly above the neutral axis of the beams. However, it is believed that the arrangement shown in FIG. 2 is economical and facilitates fabrication.

The channel members 29 are provided at the ends of the beams 14,16 to provide the necessary edge stiffness to sustain the compressive forces developed due to the arching action inherent in the deck. The disposition of the channel members 29 provides their major flexural rigidity in a horizontal plane with the studs 32 being effective to connect mechanically the deck 30 to the channel members 29.

The efficacy of the load supporting structure is illustrated by the following experimental test results.

First Model

Figure 5A:
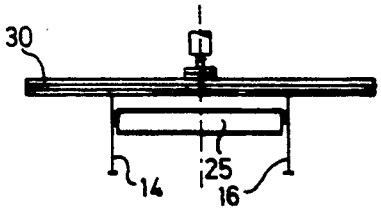
FIG. 5a is a cross-section of a model used in the development of the structure of FIGS. 1-4.
Figure 5B:
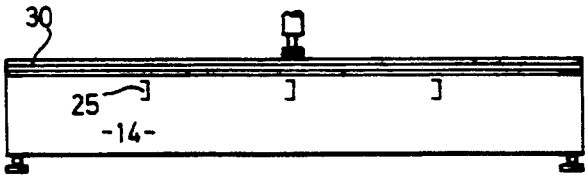

For the first text, a half-scale model of a two-girder bridge was constructed. Details of the model are shown in FIGS. 5a and 5b where reference numerals are used in the embodiment of FIGS. 1–4 to identify like components. As shown in this figure, the 100 mm thick concrete deck slab 30 was supported by two steel girders 14,16 and the model had only three intermediate diaphragms 25, and none at the supports.

The deck slab concrete contained 38 mm long fibrillated polypropylene fibres (FORTA Corporation). These fibres were added to the ready-mixed concrete just prior to placement in the amount of 0.34% by weight (or 0.88% by volume). Immediately prior to placement, the necessary degree of workability of concrete to cast the slab was achieved by adding water rather than by the use of the customary superplasticizer. The concrete did not contain any steel reinforcement.

The deck slab was tested under a central rectangular patch load measuring 257 mm×127 mm, with the latter dimension being in the longitudinal direction of the bridge. As shown in FIGS. 5a and 5b, the load was applied through a thick steel plate and a thin neoprene pad to represent the dual tires of a heavy commercial vehicle. The deck slab of the first model failed at a load of 173 Kn. The mode of failure was not that of punching shear, as is observed in deck slabs with conventional steel reinforcement.

Shortly before collapse, a vertical crack was observed at the free transverse edge of the deck slab, roughly midway between the girders. This crack indicated a lack of lateral restraint to the deck slab, especially at the ends of the bridge.

Second Model

Realizing that the deck slab of the first model lacked lateral restraint at the bridge supports, the collapsed deck slab was carefully removed and end diaphragms added to the steel framework. With the addition of these end diaphragms, which consisted of two channels and a new deck slab, the second model resulted. The deck slab of the second model, having the same dimensions as that of the first, was cast in the same way except that superplasticizer was added instead of water to achieve workability. Both the compressive and tensile strengths of concrete were improved substantially by the user of the superplasticizer. This deck slab was also tested under a central rectangular patch load. Once again, the deck slab of the second model did not fail in punching shear. At 222 Kn the failure load was somewhat higher but the mode of failure was practically the same as that of the deck slab of the first model.

Review of the results of the first two tests led to the realization that in conventionally-reinforced deck slabs, the transverse steel reinforcement participates in restraint of the lateral movement of the top flanges of the girders. This restraint permits the development of the arching system which is responsible for the enhanced strength of the slab and the punching shear mode of failure. The diaphragms of the first two models, having been lightly welded to the webs of the girders, could not restrain effectively the lateral movement of the girders above their points of connection at the webs. This lateral movement was obviously enough to keep the arching action from developing in the first two models.

Third Model

A third model was constructed by using the steelwork of the second model with the straps 28 and lower channels 25 at the intermediate diaphragms being added.

These additional steel straps comprised bars of 64 mm×10 mm cross-section spaced a 457 mm centres welded to the underside of the upper flanges of the girders. These straps represented about 1.4% of the area of concrete, which is considerably more than the minimum 0.6% transverse steel required as reinforcement in conventional deck slabs designed for punching shear in accordance with the standards set by the Ontario Highway Bridge Design Code (OHBDC, 1990). However, deck slabs designed for flexure often contain more transverse steel than 1.4% of the concrete area.

The concrete for the deck slab of the third model had the same mix as that used for the second model.

The deck slab of the third model failed under a central load of 418 Kn in a punching shear failure mode thus confirming the hypothesis that the necessary lateral restraint to the deck slab can be provided by the steel straps. Unlike that in the first two models, the deck slab failure in this model was highly localized with the rest of the slab remaining virtually undamaged.

Taking advantage of the localized failure under the central load (location 1), the deck slab was tested at two other locations. Locations 2 and 3 were a distance 0.86S and 0.43S from the closer transverse free edge, respectively, where S is the girder spacing.

Tests on locations 2 and 3 led to failure loads of 316 and 209 Kn, respectively; these failure loads are respectively 0.76 and 0.50 times the failure load at the centre. It was obvious that as the load moved towards the unstiffened transverse free edge of the deck slab 30, the longitudinal restraint declined and the failure mode degenerated towards a flexural one.

It is not difficult to conclude that the degree of restraint in the longitudinal directions falls away as the reference point moves towards the transverse free edge of the deck slab. This drop in restraint caused the slab to fail at location 2 in a hybrid failure mode rather than pure punching shear. Contrary to the requirements of the OHBDC (1990), the transverse edges of the deck slab of the third model were not stiffened.

Fourth Model

Figure 6A:
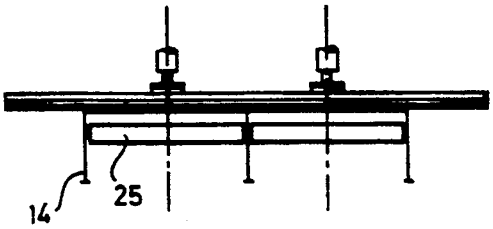
FIG. 6a is a cross-section similar to FIG. 5a of a further test performed on the model.
Figure 6B:
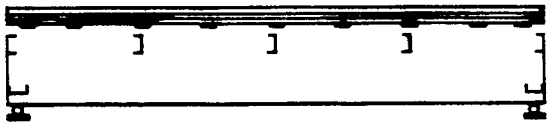

Despite the encouraging results of the tests on the third model, there remained a crucial uncertainty about the ability of the fibre reinforced concrete (FRC) deck slab to sustain a pair of concentrated loads which straddle a girder and cause tensile stresses in the concrete above it. A fourth model was, therefore, constructed to study the behaviour of the slab under pairs of loads, one on either side of an internal girder. As shown in FIGs. 6a and 6b, the fourth model was practically the same as the third model except for an additional girder and a larger overall width of the deck slab. The deck slab of the fourth model was cast by using a superplasticizer in the same way as the deck slab of the third model.

The deck slab of the fourth model was first tested under a pair of rectangular patch loads straddling the middle girder at the mid-span of the model. This test location is identified as location 1 in FIG. 7. The test at this location resulted in simultaneous punching shear failure under the two loads, with each loading pad carrying a load of 418 Kn. Of particular note is the fact that the failure under the two loads occurred simultaneously and in identical patterns, with the punchout at the top surface being of the same shape and size as the patch loads. It is highly significant, although somewhat fortuitous, that this failure load per loading pad was exactly the same as the failure load for the deck slab of the third model at location 1. This observation confirmed that the FRC deck slab with restrained top flanges of the girders could develop the necessary internal arching system even when subjected to concentrated loads straddling transversely on either side of an internal girder.

The highly localized nature of the failure at location 1 permitted the testing of the deck slab at other locations as well. Similarly to the tests on the third model, tests were also carried out on the fourth model at two other locations; these locations, being Nos. 2 and 3 and each a distance 0.86S from the closer transverse free edge, are identified in FIG. 4.

The test at location 2 led to simultaneous punching shear failure under the two loads at a load of 373 Kn per loading pad; this failure load is about 0.89 times the failure load at location 1. The failure at location 3, which was a mirror image of location 2, occurred under only one loading pad and at 0.84 times the failure load at location 1, i.e. at 352 Kn. The mode of failure was again that of punching shear. It is noted that although the mode of failure at locations 2 and 3 was that of punching shear, the punched out area of the slab in these cases was slightly larger than at location 1 indicating somewhat reduced in-plane restraint.

Tests at locations 2 and 3 have confirmed that the proximity of the loads to the unstiffened transverse free edges of deck slabs tends to reduce its capacity to sustain concentrated loads.

It will be seen from the above test results that a load supporting structure can be formed by providing a supporting structure that exhibits the necessary lateral stiffness and longitudinal stiffness to permit the deck to sustain the internal arching action. The lateral stiffness is provided by the lateral straps 28 positioned adjacent to the underside of the deck and the longitudinal stiffness is provided by the channel members 29 at the ends of the beams 14,16.

Figure 7:
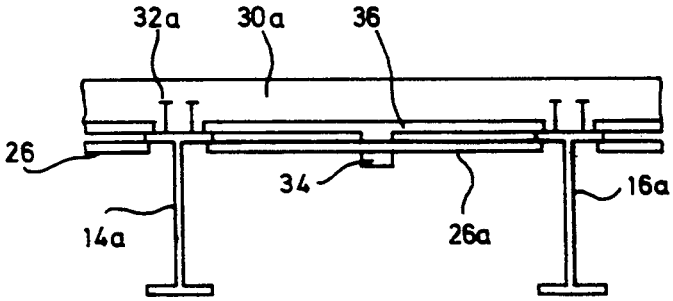
FIG. 7 is a sectional view, similar to FIG. 2, of a further embodiment of a load supporting structure.

The deck 30 is formed as described above by using conventional plywood sheathing that is removed after the deck has cured. However, the provision of the straps 28 may complicate the removal of the sheathing in some cases. A further embodiment of the load supporting structure is shown at FIG. 7 in which this disadvantage is obviated or mitigated. Like components will be identified with like reference numerals with a suffix "a" added for clarity.

In the embodiment of FIG. 7, the sheathing of the formwork is provided by thin stay-in-place carbon fibre reinforced concrete (CFRC) panels 36 that are supported on the flanges *22a* of the beams 14*a*,16*a*. After the FRC has been poured, the panels 36 become integral with the deck 30*a*. The CFRC panels 36 are typically 25 mm to 50 mm thick and are optionally supported between the beams 14*a*,16*a* during pouring of the deck 30*a* by temporary stringer 34. The technology for producing CFRC panels is well established. CFRC panels have been used as curtain walls in buildings. As such, the nature of the panels is well known in the art and will not be described further.

After placement of the CFRC panels 36, the deck 30*a* may be poured and allowed to cure. The concrete used in the deck 30*a* conforms to the specifications described above. The CFRC panels 36 are left in place after the deck 30*a* has been poured and become an integral part of the deck 30*a*, thereby avoiding the need for subsequent removal.

It will be noted that the flanges 22*a* allow placement of the panels 36 without interfering with the connection between the deck 30*a* and the beams 14*a*,16*a* provided by the studs 32*a*.

It will be appreciated that the lack of reinforcement in the deck 30 limits the permissible overhang of the deck on the beams 14,16 so that the beams should be located adjacent the longitudinal edges of the deck.

In the embodiments described above, the straps 26 have been spaced from the underside of the deck 30. This is preferred to minimize corrosion. However, it is contemplated that the benefits of a reduced thickness for the deck could also be obtained by forming the deck with the straps 26 embedded in the surface of the deck. Although the effect of corrosion is not diminished, nevertheless the straps 26 remain accessible and may be replaced if necessary without disturbing the deck. The straps 26 are still effective to prevent lateral displacement of the beams 14,16 and allow the arching action in the deck to be obtained. In each case, however, the beams and straps co-operate to provide a structure of sufficient stiffness to allow the arching action to develop within the deck and transfer loads to the beams, thereby avoiding the need for steel reinforcement as an integral part of the deck.

We claim:

1. A load supporting structure to span a pair of spaced vertical supports, said structure comprising a pair of laterally spaced beams extending between the supports and each having an upwardly directed support surface, tension members extending between said beams and being secured thereto to inhibit relative lateral movement of said support surfaces, a pair of transverse structural members extending between said beams at longitudinally spaced locations and each having an upwardly directed support surface, a deck supported on said support surfaces of said beams and said structural members and having an upper load supporting surface and a lower load transfer surface supported on said support surfaces, and fastening means extending between said support surfaces and said deck about the periphery thereof to inhibit relative movement between said deck and said support surfaces, said deck being formed from concrete impregnated with non-metallic fibres and being devoid of structural steel reinforcement between said support surfaces, said deck being dimensioned to transfer loads imposed on said upper surface of the deck to said support surfaces through arching action within said deck, said support surfaces providing sufficient stiffness to the periphery of said deck to sustain compressive forces within said deck upon application of a load thereto.

2. A load supporting structure according to claim 1 in which said support surfaces are formed on an upper edge of each of said beams and said tension members extend between said upper edges.

3. A load supporting structure according to claim 1 wherein said tension member are straps attached to said beam at spaced intervals.

4. A load supporting structure according to claim 3 wherein the straps are disposed perpendicular to the said beams.

5. A load supporting structure according to claim 1 wherein said metallic fibres are distributed within concrete with greater than 5 parts by volume of fibre to 1000 parts by volume concrete.

6. A load supporting structure according to claim 1 wherein said tension members are spaced from said load transfer surface of said deck.

7. A load supporting structure according to claim 5 wherein the fibres are polypropylene.

8. A load supporting structure according to claim 1 wherein said deck has a tensile strength not less than 20% of its compressive strength.

9. A load supporting structure according to claim 1 wherein said load supporting surface and said load transfer surface are spaced apart a distance that is at least 1/14 of the span between said beams.

10. A load supporting structure according to claim 5 wherein said fibres have a diameter not more than 0.05 mm and a length of not more than 40 mm.

11. A load supporting structure according to claim 1 wherein said transverse structural members are disposed to provide maximum stiffness in a horizontal plane.

12. A load supporting structure according to claim 11 wherein said structural members are channel members.

13. A load supporting structure according to claim 1 wherein said support surfaces of said beams and said transverse structural member are disposed in a common horizontal plane.

14. A load supporting structure according to claim 13 wherein said support surfaces of said beams and said transverse structural members are disposed below said load transfer surface.

15. A load supporting structure according to claim 14 wherein said fastening means includes a plurality of studs uniformly spaced about the periphery of said deck and projecting upwardly from said support surfaces.

16. A load supporting structure according to claim 14 wherein said load supporting surface and said load transfer surface of said deck are spaced apart a distance that is at least 1/14 of the lateral spacing between said beams.

17. A load supporting structure according to claim 16 wherein said non-metallic fibres are distributed within the concrete with greater than 5 parts by volume of fibre to 1000 parts by volume of concrete.

18. A load supporting structure according to claim 17 wherein said fibres have a diameter not more than 0.05 mm and a length of not more than 40 mm.

19. A load supporting structure according to claim 18 wherein said deck has a tensile strength not less than 20% of its compressive strength.

* * * * *

UNITED STATES PATENT AND TRADEMARK OFFICE

CERTIFICATE OF CORRECTION

PATENT NO. : 5,339,475

DATED : August 23, 1994

INVENTOR(S) : Leslie Gordon Jaeger et al

It is certified that error appears in the above—identified patent and that said Letters Patent is hereby corrected as shown below:

Column 2,

| | | |
|---|---|---|
| between lines 19 and 20 | insert | --FIG. 5b is a longitudinal section of the model of Figure 5a;--; |
| in line 21 | delete | --and--; |
| between lines 21 and 22 | insert | --FIG. 6b is a longitudinal section of the model of Figure 6a; and--. |

Signed and Sealed this

Fifteenth Day of November, 1994

Bruce Lehman

*Attest:*

BRUCE LEHMAN

*Attesting Officer*

*Commissioner of Patents and Trademarks*